United States Patent [19]

Hatanaka

[11] 4,192,467

[45] Mar. 11, 1980

[54] DOCUMENT SHREDDER

[76] Inventor: Takefumi Hatanaka, No. 276-19, Higashihiraga, Matsudo-shi, Chiba-ken, Japan

[21] Appl. No.: 934,127

[22] Filed: Aug. 16, 1978

Related U.S. Application Data

[62] Division of Ser. No. 806,215, Jun. 13, 1977, Pat. No. 4,124,169.

[30] Foreign Application Priority Data

May 6, 1977 [JP] Japan ..... 52-51250

[51] Int. Cl.[2] ..... B02C 23/02

[52] U.S. Cl. ..... 241/34; 241/222; 241/202

[58] Field of Search ..... 241/33, 34, 63, 200, 241/202, 222, 223; 100/53; 83/366

[56] References Cited

U.S. PATENT DOCUMENTS

| | | | |
|---|---|---|---|
| 929,960 | 8/1909 | Low | 241/100 X |
| 2,435,030 | 1/1948 | Brady | 241/222 |
| 2,639,096 | 5/1953 | Hinerfeld | 241/222 |
| 2,916,985 | 12/1959 | Beach | 100/DIG. 2 |
| 3,620,461 | 11/1971 | Pelleschi | 241/100 |
| 3,837,586 | 9/1974 | Perschbacher et al. | 241/222 X |
| 3,921,920 | 11/1975 | Brocard | 241/236 X |
| 4,018,148 | 4/1977 | Wolbrink | 100/53 |
| 4,061,282 | 12/1977 | Walker et al. | 241/222 |

*Primary Examiner*—Robert L. Spicer, Jr.
*Attorney, Agent, or Firm*—Frank J. Jordan

[57] ABSTRACT

A document shredder which comprises a strip cutter to cut waste document into strips, a chip cutter to cut the strips into chips, and a minuting device disposed downstream of the chip cutters to cut the chips into pulp-like mass. The minuting device includes a housing having a conical surface formed with cutting teeth, and a conical rotary body formed with cutting teeth in engagement the cutting teeth of the housing.

3 Claims, 7 Drawing Figures

DOCUMENT SHREDDER

RELATED U.S. APPLICATION

This is a division, of application Ser. No. 806,215, filed June 13, 1977, now U.S. Pat. No. 4,124,169.

This invention relates to a shredder, and more particularly to a document shredder which eliminates the possibility of the leakage of confidential information contained in disposed documents, paper sheets and drawings by processing this material in such a manner as will make reconstruction impossible.

In conventional document shredders disposed documents are cut into paper strips in a given direction by means of a rotating roller which consists of a plurality of cutting edges. As these paper strips still bear readible numbers and characters and are cut in a single direction it is possible to readily reconstruct and reassemble them into their original state. Although efforts have recently been made to overcome these problems by shredders which have the capability to cut the paper strips into chips, reconstruction is still possible since the chips are comparatively large in size and continue to bear readible characters, numbers and the like. Today there is also the danger that further advancements in computor technology will provide the capability of reconstructing the chips and thus recovering the original document by making use of the directions in which the chips have been cut and the positional relationship between the readible numbers and characters. This is an extremely important problem with regard to national security and the protection of industrial secrets in such cases where the government and private industry must dispose of secret or top-secret documents.

Conventional shredders which cut documents into paper strips are extremely inconvenient in that the strips comprise a large amount of bulk necessitating that the shredder receptacle be frequently emptied. When a packing mechanism is installed within the shredder in order to reduce the volume of the bulk, this necessarily complicates the over-all construction and increases it in size. Consequently, receptacles or bags to be attached to the exterior of the shredder case for the purpose of collecting the paper strips have been proposed. However, the shredder and receptacle according to this design not only require a large amount of space but also detract from the appearance of the office since the receptacle is exposed to view. Hence, shredders of this type inevitably require installation in a specially designated room, a factor which is not conductive to good economy. Furthermore, the fact that disposed documents are manually fed into a conventional shredder several sheets at a time is a time consuming operation when a large amount of material is to be processed and is thus an extremely uneconomical situation in view of today's high cost of labor.

Accordingly, the object of the invention is the provision of a novel document shredder especially adapted to process disposed documents including secret or top-secret documents relating to governmental or industrial matters.

A further object of the invention is the provision of a document shredder adapted to automatically destroy disposed documents in a continuous manner such that the processed documents will be completely unintelligible.

Another object of the invention is the provision of a compact document shredder adapted to process disposed documents in such a manner as will greatly reduce the bulk of the shredded material.

Still another object of the invention is the provision of a document shredder in which the cover of the shredder is electrically locked to the casing during the automatic processing of disposed documents.

Other objects and advantages of the invention will be apparent upon reading the following detailed description of a preferred embodiment of the invention in conjunction with the accompanying drawings, in which.

Figure 1:
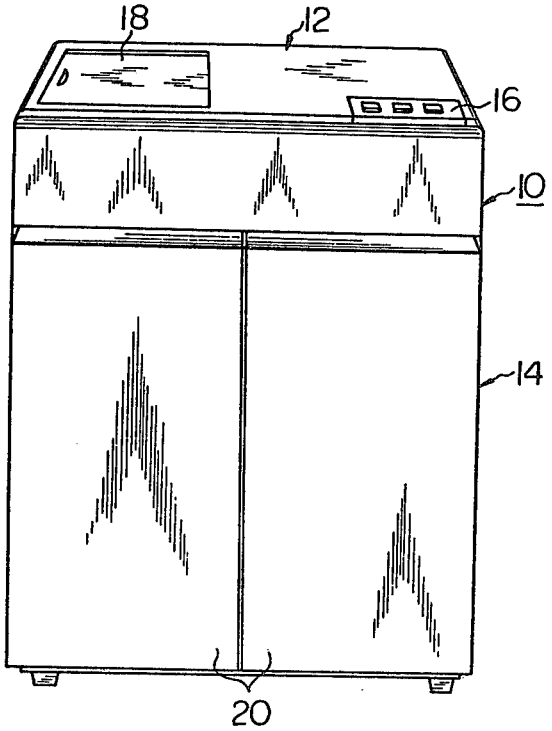
FIG. 1 is a perspective view of a preferred embodiment of a document shredder according to the present invention.

FIG. 1 is a perspective view of the document shredder in accordance with the invention. Reference numeral 10 denotes the shredder casing, 12 a document processing section, and 14 a collection section. Document processing section 12 includes a switch board 16 equipped with an automatic operation switch, manual operation switch, stop switch and other switches as required. Processing section 12 is also formed to include a platform and an accommodation compartment for temporarily keeping the disposed documents in a stand-by condition. A cover 18 capable of being open and closed is mounted to the top of the casing. Collection section 14 houses a receptacle or a bag (not shown) for the purpose of collecting the processed documents and is provided with doors 20 which allows the receptacle or bag to be removed.

Figure 2:
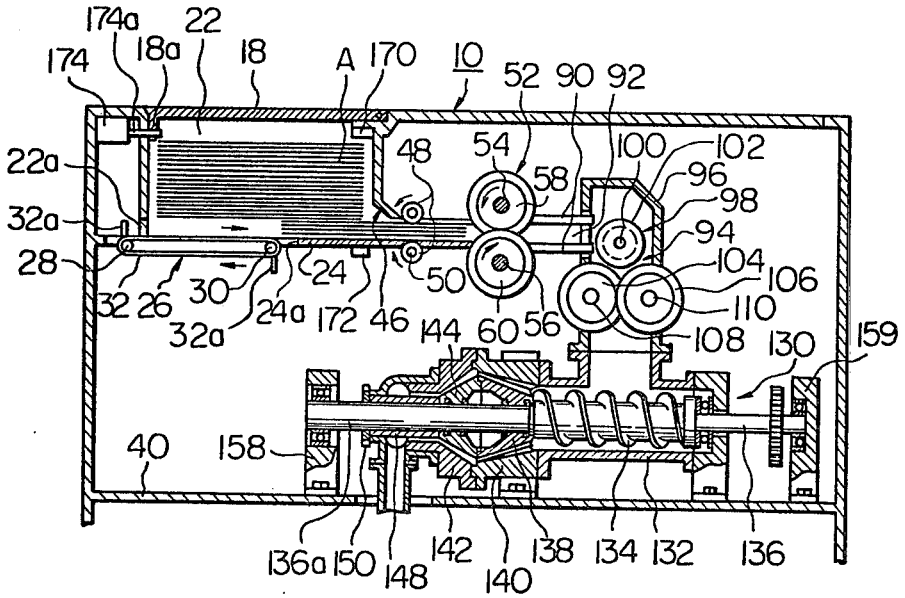
FIG. 2 is a partial cross section view of the shredder shown in FIG. 1.

In FIG. 2, casing 10 is formed to include a stand-by compartment 22 into which documents to be processed are placed and stacked upon platform 24. Cut-outs **22*a* and 24*a* are formed in the rear wall of stand-by compartment 22 and in platform 24, respectively. Installed adjacent platform 24 is a fixed-feed mechanism 26 adapted to feed, at one time, a predetermined number of sheets from the documents which have been stacked on the platform. Fixed-feed mechanism 26 is open to the stand-by chamber 22 and is equipped with a pair of rotational shafts 28, 30 mounted parallel to the lower surface of platform 24 and which support a pair of feed belts 32, 34. These feed belts are disposed within cut-out 24*a* so that their upper surface substantially coincides with the upper surface of platform 24, and the outer peripheral surface of each belt 32, 34 is formed to include a plurality of pushing members 32*a*, 34*a*** the height of which are set so that a prescribed number of sheets can be simultaneously fed at one time.

Figure 3:
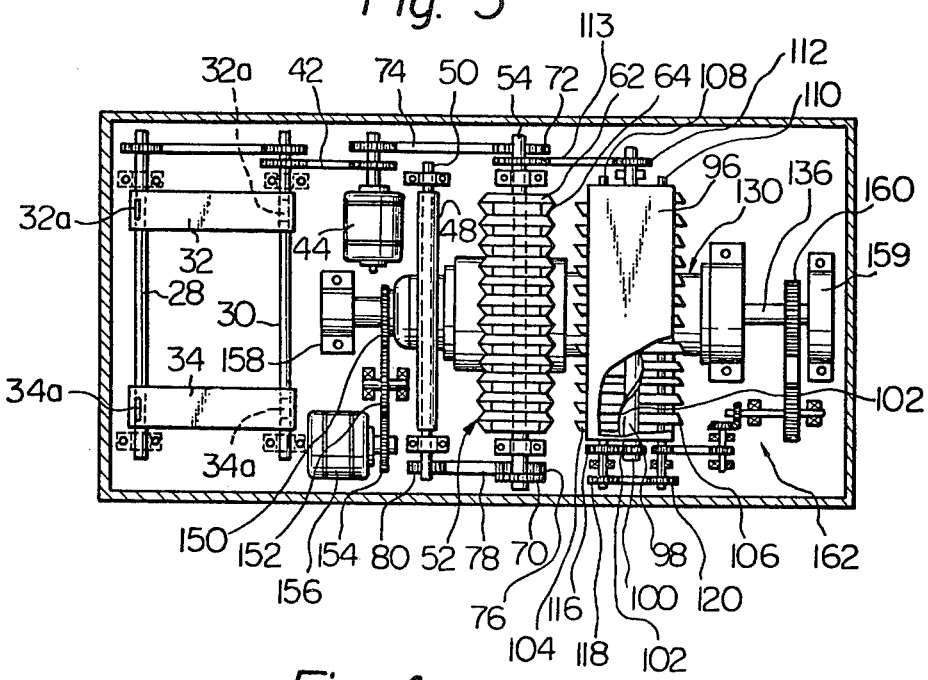
FIG. 3 is a plan view illustrating a drive connection mechanism for the shredder shown in FIG. 2.

As will be appreciated from FIG. 3, rotational shafts 28, 30 are driven in the clockwise direction in FIG. 2 through the intermediary of a belt 42 rotated by motor 44 secured to mounting plate 40. At this time, pushing members **32*a*, 34*a*** come into abutting contact with the edges of documents A and feed a prescribed number of sheets as illustrated in FIG. 2.

The front wall of stand-by compartment 22 is formed to include a paper-feed opening 46 the height of which is set so as to be slightly larger than the thickness of the stack of sheets to be fed therethrough. Installed adjacent paper-feed opening 46 is a pair of feed rollers 48 mounted on shafts 50 so as to rotate in mutually opposite directions and supply a destroy means such as a strip cutter 52 the paper which has been delivered by the feed mechanism 26.

In the embodiment shown in FIGS. 2 and 3, strip cutter 52 includes shearing rollers 58, 60 secured to respective parallel shafts 54, 56, each of the shearing rollers comprising a plurality of disks.

As illustrated in FIG. 3, gears 70 fixed to respective parallel shafts 54, 56 engage each other and permit shearing rollers 58, 60 to rotate in mutually opposite directions. Secured to shaft 56 is a gear 72 which is driven by motor 44 through a drive chain 74. Still another gear 76 is secured to shaft 56 and a gear 80 to rotational shaft 50, these two gears being linked by a chain 78 or by any other suitable means.

Shearing rollers 58, 60 simultaneously cut a prescribed number of sheets into strips. Installed immediately downstream of the cutting rollers are a plurality of strip guides 90 corresponding to the respective disks which comprise the shearing rollers. This arrangement prevents the cut paper strips from being taken up by rollers 58, 60 and allows the strips to be delivered to a chip cutter 94 through a passage 92 defined between the guides 90.

Chip cutter 94 includes passages 92 and a communicating housing 96 which is provided with a deflection member 98 comprising a horizontal shaft 100 rotatably supported within the housing 96, and a screw portion 102 provided on the horizontal shaft. Paper strips supplied from passage 92 to housing 96 are transversely deflected by the screw rotating clockwise in the drawing of FIG. 2 and are allowed to fall onto the cutting rollers 104, 106 of chip cutter 94. Cutting rollers 104, 106 are secured to horizontal shafts 108, 110 and a gear 112 fixed to one end of the horizontal shaft 100 of deflection member 98 is linked to the gear mounted on shaft 56 through the intermediary of chain 113. Secured to the other end of horizontal shaft 100 is a gear 114 linked by means of a chain to gear 116 mounted on shaft 108. Secured to horizontal shaft 108 is a gear 118 linked by means of a chain to gear 120 mounted on horizontal shaft 110, whereby rollers 104, 106 rotate in mutually opposite directions. Thus, paper strips are cut into chips and then fed on to a minuting device 130.

Figure 5:
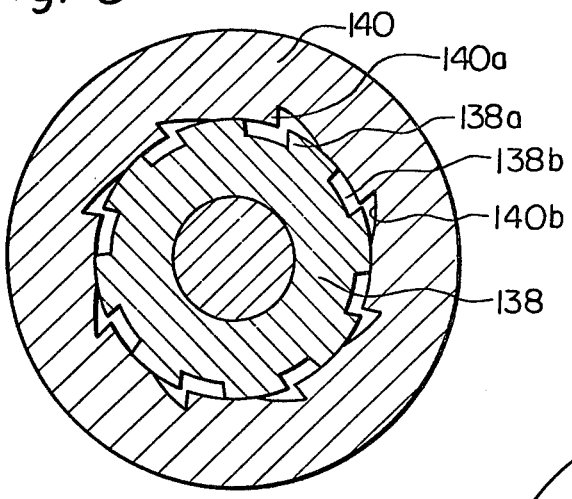
FIG. 5 is a radial cross sectional view of the minuting device shown in FIG. 4.
Figure 6:
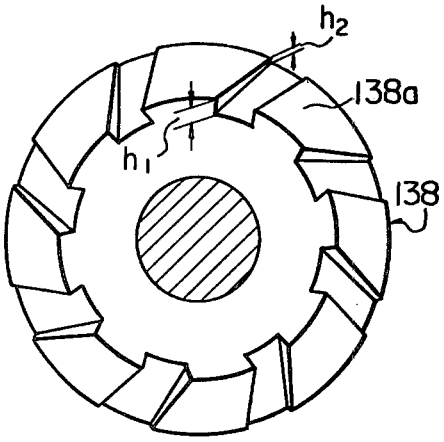
FIG. 6 is a front view of a part of the minuting device shown in FIG. 5.

Minuting device 130 comprises feed, minuting and compressing sections. The feed section comprises a cylindrical housing 132 having an inlet opening at a downstream side of the chip cutter 94 and an outlet communicating with the minuting section to feed the chips thereto, and a rotational shaft 136 rotatably supported within the housing and having a screw portion 134. It should be appreciated from FIG. 4 that a rotary body 138 which forms a portion of the minuting section is supported by rotational shaft 136 at the constricted portion 136*a* of its diameter through the intermediary of a bearing. Rotary body 138 possesses a conical configuration and is in engagement with the conical inner surface of housing 140 which is connected to housing 132. The outer periphery of rotary body 138 is formed to include a plurality of substantially axially extending teeth 138*a*. In FIG. 6 it can be seen that these teeth 138*a* taper from the small diameter portion to the larger diameter portion of the rotary body such that $h_1 > h_2 > 0$, and that the teeth define a sharp angle with respect to the shaft of the rotor 138. In similar fashion, the conical inner surface of housing 140 includes a plurality of tapered teeth 140*a* which also include substantially axially extending chip guide grooves 140*b* (FIG. 5) formed adjacent thereto. In the radial cross-section each guide groove gradually deepens toward its neighboring tapered tooth 140*a* (FIG. 5) and is formed so as to define a tapered axial cross-section. According to this construction, chips delivered to the side of the housing by screw 134 are fed into the space defined between grooves 138*b* and 140*b* and are further cut by means of the tapered teeth 138*a*, 140*a* during the rotation of rotary body 138. During this interval the chips, under the influence of centrifugal force, collide with the grooves 140*b* and advance through them moving to the left in FIg. 4. At this time the chips are finely cut into a pulp-like mass, as they advance in the axial direction, owing to the fact that the thickness of the grooves 140*b* gradually decreases axially of the shaft.

Figure 4:
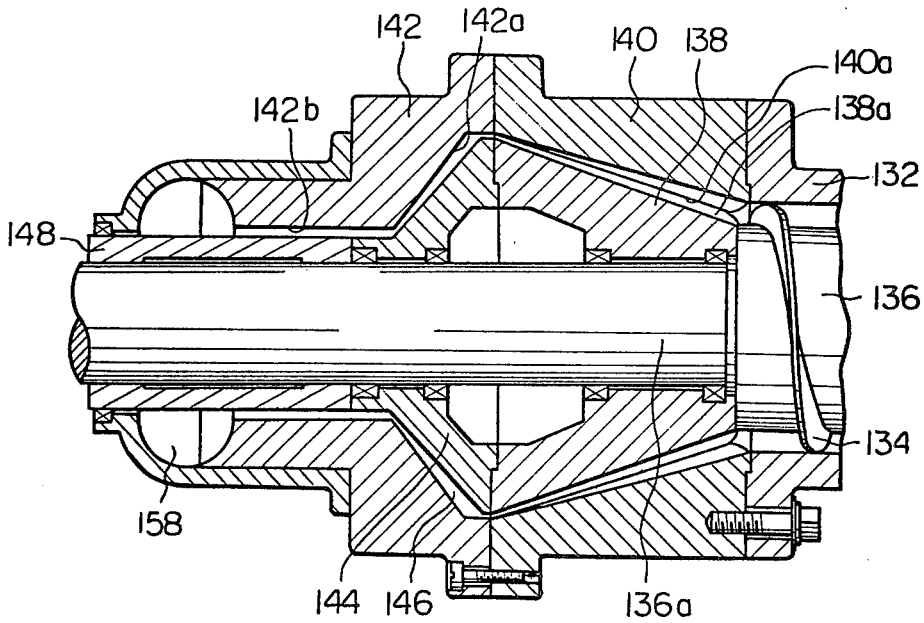
FIG. 4 is an enlarged cross sectional view of a minuting device forming part of the shredder shown in FIGS. 2 and 3.

In FIG. 4, housing 142 which constitutes a portion of a compression device is connected to housing 140. Housing 142 is formed to include a conical inner wall 142*a* and a bore 142*b* extending in the axial direction. A conical rotary body 144 is rotatably supported by rotational shaft 136 at the constricted portion 136*a* of its diameter through the intermediary of a bearing and rotates in unison with rotary body 138. The outer wall of conical rotary member 144 is inclined so as to meet the inner wall of housing 142 so that the paper pulp will be compressed in the conical space 146. One end of a bush 148 rotatably supported by the constricted portion 136*a* of the shaft is dynamically coupled to rotary body 144 while the other end is fixed to gear 150 which is coupled across gears 152, 154 to driving motor 156 and rotated at a high speed thereby. The compressed pulp is thus passed through the annular space defined between bore 142*b* and bush 148 and discharged from outlet passage 158 into a receptacle located within case 10. Reference numeral 148 denotes a bearing for supporting the constricted portion 136*a* of shaft 136. The end of rotational shaft 136, as illustrated in FIGS. 2 and 3, is supported by a bearing 159 and is equipped with a gear 160 which is coupled to shaft 110 by a gear transmission mechanism 162 and driven at a slow speed.

In FIG. 2, reference numeral 170 designates a light source installed within case 10 at the upper portion of stand-by compartment 22, and reference number 172 denotes a photo-electric light detector comprised of Cds cells or the like and mounted on platform 24 in order to detect the presence of documents within the stand-by compartment. Reference numeral 174 denotes a locking device mounted to case 10 and adapted to lock cover 18 to the case 10 by causing a locking element 174*a* to engage with a locking hole 18*a* in the cover 18 when the shredder is operating in the automatic mode and there are documents located in the stand-by compartment 22.

Figure 7:
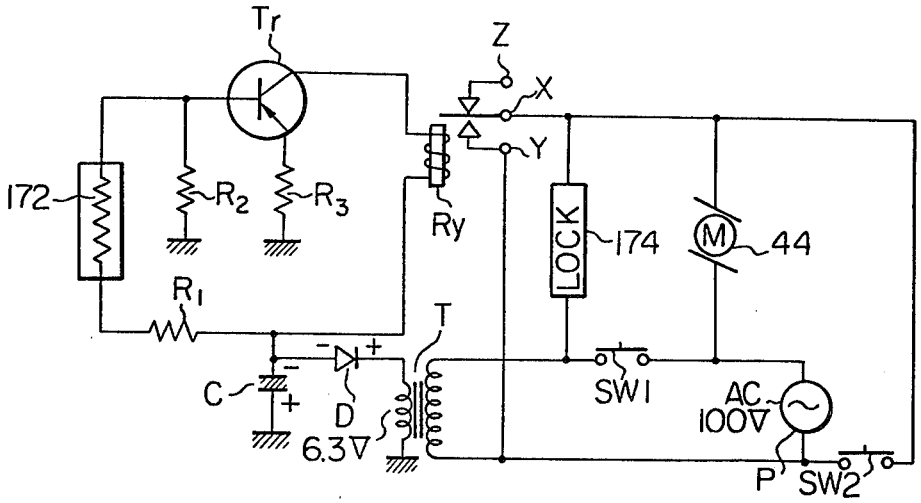
FIG. 7 is a schematic view of an electrical control circuit for the shredder shown in FIGS. 2 and 3.

FIG. 7 depicts a control circuit utilized in the document shredder of the present invention. In the circuit, one end of a photo-electric detecting element 172 is connected to a condenser C and diode D across a resistor $R_1$. One side of the condenser C is grounded while the diode D is connected to the secondary side of a transformer T. The other end of detecting element 172 is connected to the base of a transistor Tr and the base is in turn connected to ground across a resistor $R_2$. The emitter of transistor Tr is connected to ground across resistor $R_3$, and the collector is connected to a relay Ry. Locking mechanism 174 is connected across a terminal X of relay Ry and automatic operation switch $SW_1$ which is connected to one terminal of an AC power source. The other terminal of the power source is connected to the terminal Y of relay Ry and the primary winding of transformer T. Finally, manual operation switch $SW_2$ is connected between one terminal of the AC power source and motor M. According to this arrangement, placing documents A in the stand-by compartment interrupts the beam of light transmitted by light source 170 and intercepted by light detector 172 the resistance of which therefore drops. Thus, when switch $SW_1$ is depressed after the documents have been placed in the stand-by compartment and the cover 18 is closed, transistor Tr is allowed to conduct due to the decrease in detector resistance. This results in a connection between terminal Y and terminal Y and an accompanying flow of current through locking mechanism 174 so that locking element 174 engages with locking hole 18*a* in cover 18 whereby the cover is locked to case 10. Since motor 44 is activated during this interval, fixed feed mechanism 26 operates and automatically feeds a given quantity of documents A to strip cutter 52. The strips obtained from strip cutter 52 are then further cut and reduced to chips in chip cutter 92 and fed on to minuting device 130 where they are reduced to pulp. When there are no longer any documents left in the stand-by compartment during automatic operation, the beam of light transmitted by light source 170 once again strikes the light detector 172 thereby raising its resistance and cutting off transistor Tr. Relay Ry is thus rendered non-conductive so that terminals X, Y separate and release locking mechanism 174. Thus, merely placing documents in the stand-by compartment and operating the automatic switch allows the documents to be automatically processed while the cover is locked to the case. It is therefore not necessary for the operator to feed a certain amount of documents into the shredder by hand, nor is it required to supervise the entire processing operation. Finally, when motor 44 is activated by depressing switch $SW_2$, there is no flow of current through locking mechanism 174 so that documents can be manually fed into the shredder.

What is claimed is:

1. A document shredder for processing waste documents, comprising:

means for destroying the waste documents such that the documents are rendered unintelligible;

drive means for providing driving power to said destroying means;

a casing housing said destroying means and said drive means;

a stand-by chamber formed in said casing to temporarily keep the waste documents in a stand-by condition;

feed means for feeding at least one sheet from the waste documents kept in said stand-by chamber to said destroying means;

a cover mounted on said casing to close said stand-by chamber;

means for sensing the presence of the waste documents kept in said stand-by chamber and producing an output signal in response thereto; and locking means responsive to said output signal for locking said cover to said casing while said waste documents are kept in said stand-by chamber.

2. A document shredder according to claim 1, in which said feed means is operable in response to said output signal to automatically feed said at least one sheet.

3. A document shredder according to claim 3, in which said drive means is operable in response to said output signal.

* * * * *